US006364067B1

(12) United States Patent
Glassey et al.

(10) Patent No.: US 6,364,067 B1
(45) Date of Patent: Apr. 2, 2002

(54) METHOD AND APPARATUS FOR INSTALLING ELEVATOR COMPONENTS

(75) Inventors: Thomas Glassey, Plainville, CT (US); Jean Jacques Kray, Kingersheime (FR); Patrice Letellier, Andresy (FR); Yves Fougeron, Orleans (FR)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/665,427

(22) Filed: Sep. 20, 2000

(51) Int. Cl.[7] ..... B66B 7/02

(52) U.S. Cl. ..... 187/408; 187/414; 187/900; 52/30; 52/745.2; 29/429

(58) Field of Search ..... 187/406, 407, 187/408, 411, 414, 900; 52/30, 745.2; 29/429

(56) References Cited

U.S. PATENT DOCUMENTS

| | | | | |
|---|---|---|---|---|
| 3,519,101 A | * | 7/1970 | Sieffert | 187/900 X |
| 4,345,671 A | * | 8/1982 | Tosato et al. | 29/429 X |
| 5,000,292 A | * | 3/1991 | Chapelain et al. | 187/414 X |
| 5,033,586 A | * | 7/1991 | Richards et al. | 187/900 X |

FOREIGN PATENT DOCUMENTS

| | | | |
|---|---|---|---|
| JP | 7-237847 A | * | 9/1995 |
| JP | 10-87225 A | * | 4/1998 |
| JP | 10-297841 A | * | 11/1998 |
| JP | 2000-226169 A | * | 8/2000 |
| WO | WO9840305 | | 9/1998 |

* cited by examiner

*Primary Examiner*—Eileen D. Lillis
*Assistant Examiner*—Thuy V. Tran

(57) ABSTRACT

An elevator system includes a hoistway that extends upwardly from a pit area to an upper hoistway area. A support plate extends across a lateral width of the hoistway and is mounted between a machine base and a guide rail assembly. A hoist tool is mounted within the hoistway near the upper hoistway area for lifting the machine base and rail assembly upwardly through the hoistway from the pit area to the top of the hoistway. The hoist tool supports a first set of pulleys and the support plate supports a second set of pulleys. A cable is threaded through the first and second sets of pulleys and is connected to a hoist machine for lifting the machine base and guide rail assembly to an installation position in the upper hoistway area via the hoist tool and pulley system.

11 Claims, 2 Drawing Sheets

METHOD AND APPARATUS FOR INSTALLING ELEVATOR COMPONENTS

BACKGROUND OF THE INVENTION

This invention relates to an apparatus and method for installing elevator components with a hoistway that utilizes a unique hoist tool and pulley system.

Elevators are used to transport passengers and cargo between levels in buildings. An elevator typically includes a cab that is movable along guide rails that are mounted within a hoistway. A motor and pulley arrangement, known as the machine, is mounted near the top of the hoistway, and drives a cable to move the elevator cab upwardly or downwardly in combination with a counterweight. Historically, the machine is mounted in a machine room above the hoistway. Before the cab can be installed in the hoistway, the machine components and the guide rails must be installed. Typically, the machine is supported on a base that must be lifted from a pit area at the bottom of the hoistway to an upper mounting location in the machine room.

The guide rails also have to be installed within the hoistway before the cab can be installed and must be lifted from the pit to the upper areas of the hoistway. Usually, the machine components and guide rails are assembled in the pit area and lifted with a hoist tool. Once the components are in place fasteners or other mounting methods are used to secure the components in place. The hoist tool is typically left in or near the machine room, in case it ever becomes necessary to move the machine back downwardly for replacement or repair. This is undesirable because additional space is required for the hoist tool. Additionally, a worker must be positioned within the hoistway to guide the components and rails to the proper locations, which is also undesirable.

This invention includes an improved hoisting method that utilizes an improved hoist tool and pulley assembly to install the machine components and guide rails within the hoistway without the need for a worker to be positioned within the hoistway and without the need for a separate machine room above the hoistway. Further, the improved hoisting method provides a hoist tool that allows rapid coupling and decoupling of the machine from the corresponding mounts for service and repair.

SUMMARY OF THE INVENTION

In general terms, this invention is an elevator system having a unique installation arrangement that facilitates assembling and repairing components of the system while also eliminating the need for a separate machine room. An elevator system designed according to this invention includes a hoistway having a longitudinal length, a lateral width, and a lateral depth. The longitudinal length extends from a pit area to an upper hoistway area. A machine base extends through the lateral depth. A rail assembly extends along the longitudinal length of the hoistway to guide an elevator cab upwardly and downwardly within the hoistway. A support plate is mounted between the machine base and the rail assembly. A hoist tool is mounted within the hoistway near the upper hoistway area for lifting the machine base and rail assembly upwardly through the hoistway from the pit area to a mounting location near the top of the hoistway.

In a disclosed embodiment, the hoist tool includes a first set of pulleys mounted to the hoist tool and a second set of pulleys mounted to the support plate. A hoist machine is interconnected to the first and second sets of pulleys via a cable wherein the hoist machine lifts the machine base and a guide rail assembly upwardly through the hoistway from the pit area to an upper position within the hoistway. The pulleys in the first set of pulleys are separated from each other by a greater distance than the distance between the pulleys of the second set. This allows the second set of pulleys to be positioned between the first set of pulleys when the machine base is lifted to a maximum installation height to automatically align the machine base and rail assembly within the hoistway.

A method for lifting a machine base and guide rail assembly through a hoistway to a mount location in an elevator assembly includes the following steps. A hoist tool is mounted adjacent to an upper end of a hoistway and has a first set of pulleys. A plate is mounted between the machine base and the guide rail assembly with a second set of pulleys. A cable is threaded around the first and second sets of pulleys. The cable is connected to a hoist machine and a hoist tool is used to lift the machine base and guide rail assembly through the hoistway from a pit area to a mount location near the upper end of the hoistway.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
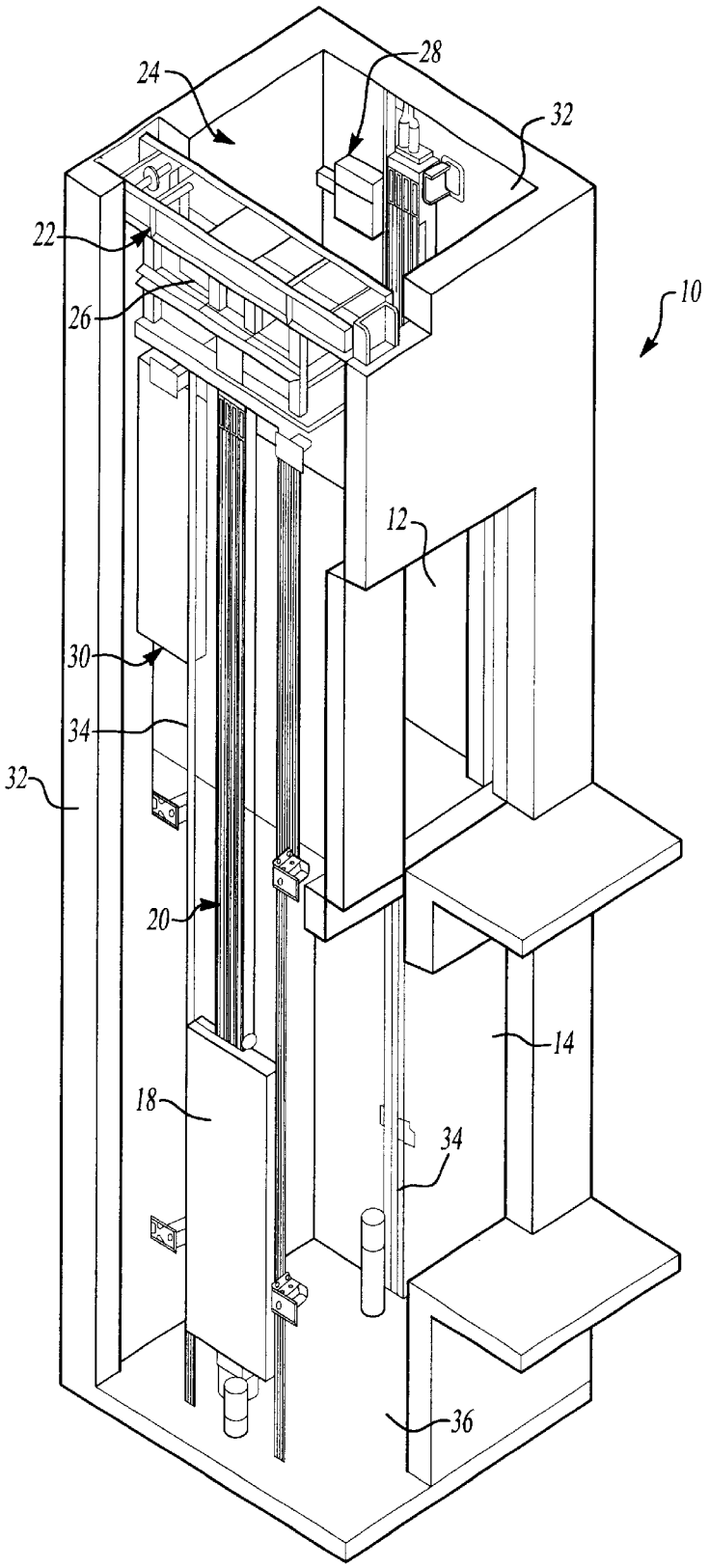
FIG. 1 is a perspective view of an elevator system.

FIG. 1 illustrates an elevator system 10 that generally includes a cab 12 installed in an elevator hoistway 14 in a known manner such that it is movable between floors in a building structure. A counterweight 18 balances the cab 12 in a typical manner. One portion of a rope or cable 20 is attached to the cab 12 while another portion is attached to the counterweight 18. The rope 20 is engaged by a machine assembly 22 located at the top of the hoistway 14 to move the cab 12. The unique configuration of this elevator system 10 allows elevator components that have traditionally been mounted in a machine room above the hoistway 14 to be mounted within the hoistway itself. Thus, components such as a hoist machine 26, governor 28, and car controller 30 are all mounted in an upper hoistway area 24 to perform standard functions as known in the art.

Elevator shaft sidewalls 32 enclose the hoistway 14. In one embodiment, shown in FIG. 1, the elevator cab 12 rides along guide rails 34 that extend vertically along the hoistway 14. The hoistway 14 has a longitudinal length, a lateral width, and a lateral depth. The longitudinal length extends upwardly (according to the drawing) from a pit area 36 to the upper hoistway area 24.

Figure 2:
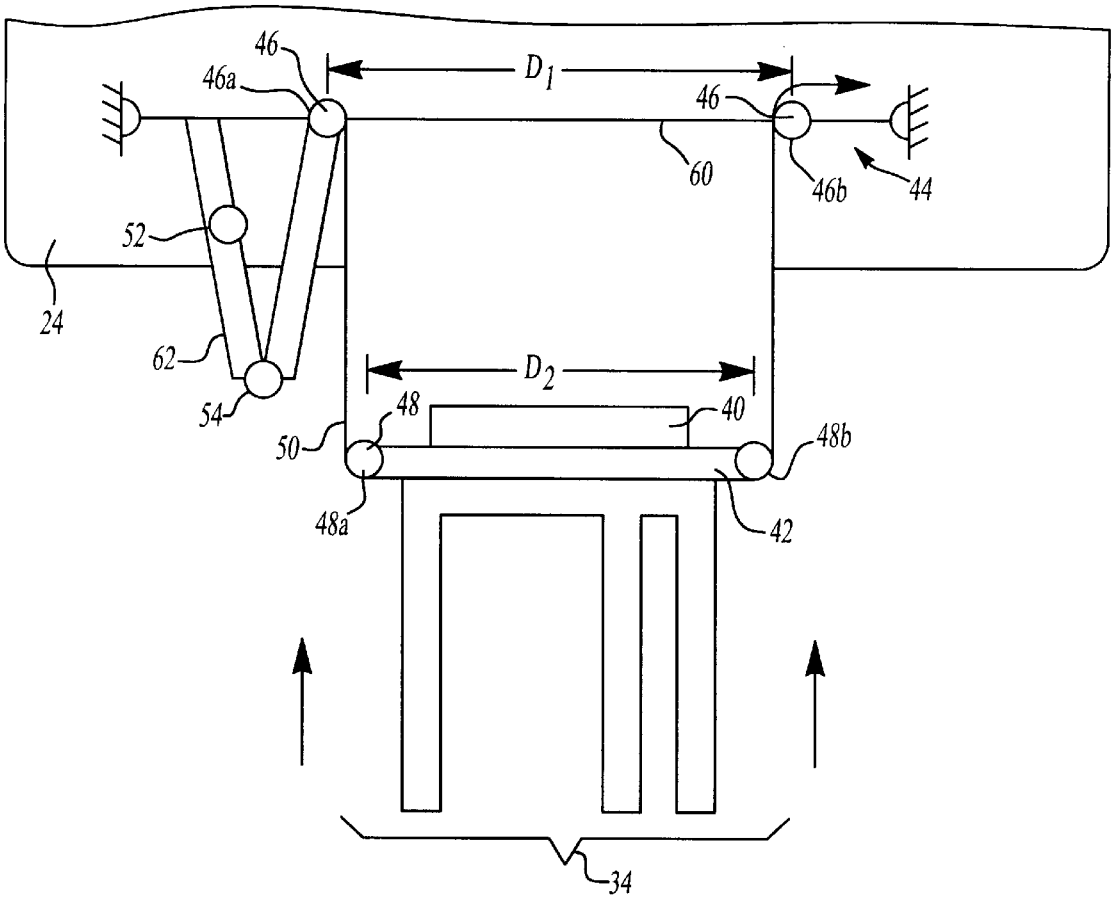
FIG. 2 is schematic view of the inventive hoist tool and pulley system for installing elevator components within a hoistway, shown in a first position.

Before the cab 12 can be installed in the hoistway 14, the machine assembly components 22 and the guide rails 34 must be installed. Typically, the machine assembly 22 is supported on a base 40, shown in FIG. 2, that must be lifted from the pit area 36 at the bottom of the hoistway 14 to an upper mounting location in the hoistway 14. The machine base 40 preferably extends across the lateral depth of the hoistway 14.

A support plate 42 is mounted between the machine base 40 and a portion of the guide rail assembly 34. A hoist tool 44 is mounted within the hoistway 14 near the upper hoistway area 24 for lifting the machine base 40 and rail assembly 34 upwardly through the hoistway 14 from the pit area 36 to the upper mounting location in the hoistway 14.

The hoist tool 44 extends across the lateral depth of the hoistway 14 and includes a first set of pulleys 46 interconnected to a second set of pulleys 48 which are mounted to the support plate 42, via a hoist cable 50. While two (2) pulleys at each location are preferred, it should be understood that additional pulleys could be used to improve stability. The hoist cable 50 is driven by a hoist machine 52 to lift the machine base 40 and rail assembly 34. The hoist machine 52 is preferably a temporary hoist machine mounted near the top of the hoistway 14 for initial installation of the various elevator system components. The temporary hoist machine 52 is used to lift the permanent hoist machine 26 to the installation position in the upper hoistway area 24 via the machine base 40.

Figure 3:
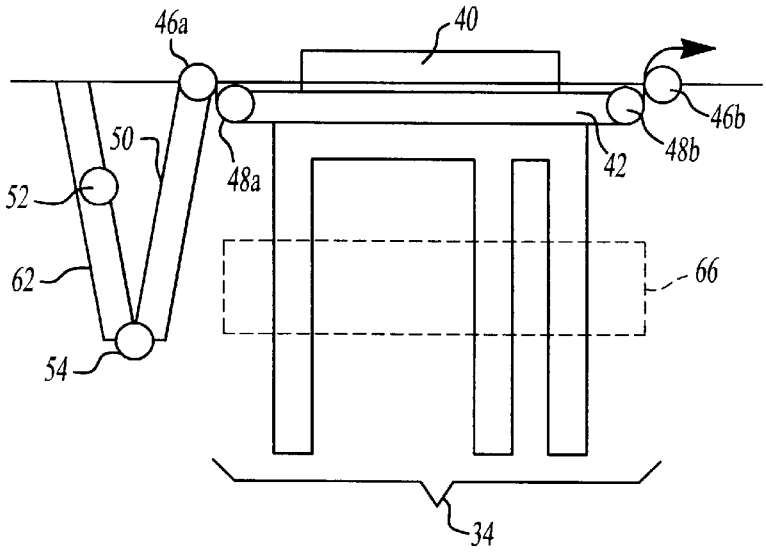
FIG. 3 is a view like FIG. 2 but shown in a second position at a maximum installation height.

The pulleys 46*a,* 46*b* in the first set of pulleys 46 are spaced apart from one another by a first distance D1 and the pulleys 48*a,* 48*b* of the second set of pulleys 48 are spaced apart from one another by a second distance D2 that is less than the first distance D1. This allows the second set of pulleys 48 to be positioned between the first set of pulleys 46 when the machine base 40 is lifted to a maximum installation height (see FIG. 3). Thus, the machine base 40 is automatically and properly aligned within the hoistway 14 without the need for a worker to be positioned within the hoistway 14.

A guide pulley 54 is also mounted on the hoist tool 44 and is positioned between the hoist machine 52 and the first set of pulleys 46. The hoist cable 50 extends from the hoist machine 52 to the guide pulley 54, to one pulley 46*a* of the first set of pulleys 46, to one pulley 48*a* of the second set of pulleys 48, to the other pulley 48*b* of the second set of pulleys 48, and then to the other pulley 46*b* of the first set of pulleys 46. The hoist machine 52 actuates the cable 50 by pulling or releasing the cable 50 around the pulleys 46, 48 to position the machine base 40 and rail assembly 34 at the proper installation position in the hoistway 14.

The hoist tool 44 includes a first portion 60 extending across the lateral depth of the hoistway 14 and a second portion 62 that extends downwardly in a longitudinal direction from the first portion 60. The first set of pulleys 46 is supported on the first portion 60 and the guide pulley 54 is supported on the second portion 62. The hoist machine 52 is also preferably positioned adjacent to the second portion 62 and below the first portion 60.

In the preferred embodiment, the guide pulley 54 is mounted on the hoist tool 44 at a vertically lower position within the hoistway 14 than the first set of pulleys 46 and at a vertically higher position within the hoistway 14 than the second set of pulleys 48.

The inventive method for lifting the machine base 40 and guide rail assembly 34 through the hoistway 14 to a mount location in an elevator assembly 10 includes the following steps. The hoist tool 44 is mounted adjacent to an upper end of the hoistway 14 and has the first set of pulleys 46 spaced longitudinally from each other along the first portion 60 of the tool 44. The plate 42 is mounted between the machine base 40 and the guide rail assembly 34 has the second set of pulleys 48 spaced longitudinally from each other along the plate 42. The hoist cable 50 is threaded through the first 46 and second 48 sets of pulleys. The cable 50 is connected to a hoist machine 52 and the hoist tool 44 is used to lift the machine base 40 and guide rail assembly 34 through the hoistway 14 from the pit area 36 to a mount location near the upper hoistway area 24.

Additional steps include threading the hoist cable 50 through a guide pulley mounted to the second portion 62 of the hoist tool 44 before threading the cable through the first pulley. The second set of pulleys 48 are then lifted to a maximum installation height at a position between the first set of pulleys 46 to automatically align the machine base 40 within the hoistway 14. A bracket 66 or other connection support is then used to secure the machine base 40 and guide rail assembly 34 to the wall 32 of the hoistway 14 as is known in the art.

This unique hoisting method and apparatus reduces the installed cost of an elevator by simplifying the installation process and thereby reducing installation hours. Additionally, the method and apparatus enables decoupling and rapid removal of the machine from its corresponding mounts during service or repair operations. Another benefit is that the method and apparatus provides safe hoisting of the machine assembly 22 without a requirement for a worker to be positioned in the hoistway 14 for guiding purposes and eliminates the need for a separate machine room.

By integrating the support plate 42 between the machine base 40 and rail assembly 34 the lifting plane is moved closer to the center of gravity than if the components were lifted from under the entire machine assembly. Preferably, the plate 42 includes two (2) pulleys 48 situated at each end to achieve 2:1 hoisting capability. The pulleys 48 positioned at each end of the plate 42 facilitate 2:1 hoisting of the machine assembly during construction by using a matching set of pulleys 46 positioned on an overhead hoist tool 44. The 2:1 hoisting ratio allows the lifting of the heavy components with less effort.

The machine assembly 22 is provided with the plate 42 attached to the machine 22 and bolted to the mount. During removal of the machine 22, the plate 42 is unbolted from the wall 32 or rail 34 mount and the machine 22 is removed using the same 2:1 system used during installation.

The foregoing description is exemplary rather than limiting in nature. Many modifications and variations of the present invention are possible in light of the above teachings. The preferred embodiments of this invention have been disclosed, however, one of ordinary skill in the art may recognize that certain modifications are possible that would come within the scope of this invention. It is, therefore, to be understood that within the scope of the appended claims, the invention may be practiced otherwise than as specifically described. For that reason the following claims should be studied to determine the true scope of protection given for this invention.

What is claimed is:

1. An elevator system comprising:

a hoistway having a longitudinal length, a lateral width, and a lateral depth, said longitudinal length extending upwardly from a pit area to an upper hoistway area;

a machine base extending across at least a portion of said lateral depth;

a rail assembly extending along said longitudinal length for guiding an elevator cab within said hoistway;

a support plate mounted between said machine base and said rail assembly; and a hoist tool mounted within said upper hoistway area for lifting said machine base and rail assembly upwardly through said hoistway from said pit area to a mounting location within said upper hoistway area.

2. The elevator system as recited in claim 1, wherein said hoist tool extends across at least a portion of said lateral depth and includes a first plurality of pulleys, a second plurality of pulleys which are mounted to said support plate, and a hoist cable that is supported by said first and second plurality of pulleys wherein said hoist cable is driven by a hoist machine to lift said machine base and rail assembly.

3. The elevator system as recited in claim 1, wherein said hoist tool includes a system of pulleys comprised of a first set of at least two pulleys mounted to said hoist tool and spaced apart from one another by a first distance and a second set of at least two pulleys mounted to said support plate and spaced apart from one another by a second distance that is less than said first distance.

4. The elevator system as recited in claim 3, wherein said second set of pulleys are positioned between said first set of pulleys when said machine base is lifted to a maximum installation height to automatically align said machine base and rail assembly within said hoistway.

5. The elevator system as recited in claim 3, including a guide pulley and a cable interconnecting said guide pulley and said first and second sets of pulleys to a hoist machine wherein said hoist machine actuates said cable to lift said machine base and rail assembly.

6. The elevator system as recited in claim 5, wherein said hoist tool includes a first portion extending across at least a portion of said lateral depth and a second portion extending downwardly in a longitudinal direction from said first portion, said first set of pulleys being supported on said first portion and said guide pulley being supported on said second portion.

7. The elevator system as recited in claim 5, wherein said guide pulley is mounted on said hoist tool at a vertically lower position within said hoistway than said first set of pulleys and at a vertically higher position within said hoistway than said second set of pulleys.

8. An elevator system comprising:

a hoistway extending upwardly from a pit area to an upper hoistway area;

a hoist tool mounted within said upper hoistway area;

a first set of at least two pulleys mounted to said hoist tool;

a second set of at least two pulleys mounted to a plate positioned between a machine base and a guide rail assembly; and a hoist machine interconnected to said first and second sets of pulleys via a cable wherein said hoist machine lifts said machine base and said guide rail assembly upwardly through said hoistway from said pit area to a mounting location within said upper hoistway area.

9. The elevator system as recited in claim 8, wherein said second set of pulleys are positioned between said first set of pulleys when said machine base is lifted to a maximum installation height to automatically align said machine base and rail assembly within said hoistway.

10. A method for lifting a machine base and guide rail assembly through a hoistway to a mount location in an elevator assembly using a hoist tool including a first set of pulleys and a plate mounted between a machine base and a guide rail assembly with a second set of pulleys, including the steps of:

(a) positioning the hoist tool mounted adjacent an upper end of the hoistway;

(b) threading a cable around the first and second sets of pulleys;

(c) connecting the cable to a hoist machine; and (d) utilizing the hoist tool to lift the machine base and guide rail assembly through the hoistway from a pit area to a mount location adjacent to the upper end of the hoistway.

11. The method of claim 10, including lifting the second set of pulleys to an installation height at a position between the first set of pulleys to automatically align the machine base within the hoistway and mounting the machine base and guide rail assembly to a wall of the hoistway.

* * * * *

UNITED STATES PATENT AND TRADEMARK OFFICE

CERTIFICATE OF CORRECTION

PATENT NO. : 6,364,067 B1
DATED : April 2, 2002
INVENTOR(S) : Glassey et al.

It is certified that error appears in the above-identified patent and that said Letters Patent is hereby corrected as shown below:

Title page,
Item [*], Notice, delete the phrase "by 0 days" and insert -- by 28 days --

Signed and Sealed this

Twenty-first Day of September, 2004

JON W. DUDAS
*Director of the United States Patent and Trademark Office*